United States Patent [19]

Goodman

[11] Patent Number: 4,854,140

[45] Date of Patent: Aug. 8, 1989

[54] PLUNGER LOCK MECHANISM

[75] Inventor: Steve F. Goodman, Wyoming, Mich.

[73] Assignee: Herman Miller, Inc., Zeeland, Mich.

[21] Appl. No.: 152,260

[22] Filed: Feb. 4, 1988

[51] Int. Cl.[4] ..... E05B 65/08

[52] U.S. Cl. ..... 70/100; 70/360; 70/369

[58] Field of Search ..... 70/360, 361, DIG. 20, 70/DIG. 27, 421, 90, 95, 99, 100, 208, 369, DIG. 62

[56] References Cited

U.S. PATENT DOCUMENTS

| | | | |
|---|---|---|---|
| 548,418 | 10/1895 | Ball | 70/360 |
| 592,606 | 10/1897 | Draullette et al. | 70/361 |
| 1,342,728 | 6/1920 | Welch | 70/360 |
| 1,951,418 | 3/1934 | Jacobi . | |
| 2,098,012 | 11/1937 | Papst | 70/208 |
| 2,648,973 | 8/1953 | Spain . | |
| 3,234,765 | 2/1966 | Kerr . | |
| 3,304,755 | 2/1967 | Johnstone . | |
| 3,345,838 | 10/1967 | Russell et al. . | |
| 3,420,077 | 1/1969 | Drazin . | |
| 3,668,906 | 6/1972 | Josephart | 70/360 X |
| 3,765,196 | 10/1973 | Balicki | 70/49 |
| 4,009,599 | 3/1977 | Patrquin | 70/90 |
| 4,398,405 | 8/1983 | Patriquin | 70/369 |
| 4,689,976 | 9/1987 | Larsen | 70/361 X |
| 4,712,400 | 12/1987 | Steinbach | 70/421 X |

FOREIGN PATENT DOCUMENTS

| | | | |
|---|---|---|---|
| 1030017 | 3/1953 | France | 70/360 |
| 423125 | 1/1935 | United Kingdom | 70/208 |

*Primary Examiner*—Lloyd A. Gall

*Attorney, Agent, or Firm*—Varnum, Riddering, Schmidt & Howlett

[57] ABSTRACT

An improved plunger lock mechanism in which a shell is supported within a lock casing for movement to and from a locked position, the shell carrying a plug lock which is rotatable relative to the shell upon insertion of an appropriate key. The plug lock carries a bolt which is movable outwardly to latching engagement with a latch shoulder provided in the casing. A cam surface is so disposed in the casing as to urge the bolt inwardly from its latching position to a retracted position upon rotation of the plug lock, thereby permitting release of the shell from its locked position.

4 Claims, 2 Drawing Sheets

PLUNGER LOCK MECHANISM

BACKGROUND OF THE INVENTION

1. Field of the Invention

The present invention relates to a plunger lock mechanism, and more particularly, to a plunger lock mechanism of the type which is useful in securing a sliding door of a cabinet or the like in its closed position.

2. Description of the Prior Art

Plunger lock mechanisms are normally operable by means of a key and include elements which are axially reciprocable between a locked position and an unlocked position; that is, they are reciprocable in opposite directions corresponding to the directions of key insertion and removal. Those plunger lock mechanisms which incorporate a conventional rotatable plug lock are reciprocable along the axis of rotation of the plug lock.

An example of such a mechanism is disclosed in U.S. Pat. No. 4,009,599, issued Mar. 1, 1977, to G. P. Patriquin, and comprises a shell reciprocable in a housing between a locked position and an unlocked position in response to operation by a key. A locking slot is provided by an aperture in the housing, and a locking wafer or bolt carried by the shell and movable radially relative thereto is releasably received in the locking slot, whereby to maintain the shell in the locked position. The wafer is biased toward its radially outer position; that is, toward its locking position, by a spring. It is retracted to its radially inner position, whereby to permit the shell to be moved to its unlocked position, by means of a stud received in a particularly configured cam opening formed centrally of the locking wafer. The stud extends axially from a conventional plug lock carried by the shell and is therefore moved in a circular path as the plug lock is rotated by means of the key. The stud, acting on the cam edge which defines the central opening of the locking wafer, operates to retract the wafer to its unlocking position. Specific reference is made to sliding door locks.

Such locks are highly subject to wear at the engaging surfaces of the stud and the cam edge of the wafer opening. Eventually, this wear may cause failure of the lock mechanism, because movement of the stud will no longer cause the locking wafer to be fully retracted from the locking slot in the housing. Also, the stud may be subjected to excessive shearing forces exerted by the cam edge if undue force is applied to the locking mechanism or the key.

Another lock of the plunger type is disclosed in U.S. Pat. No. 3,345,838, issued Oct. 10, 1967 to F. J. Russell et al. Here, a lock plunger or cylinder assembly is axially slidable within a lock case. A lock bolt extends outwardly of the lock plunger and through an opening in the lock case to be disposed in an interfering position relative to a sliding door when the lock plunger is in its innermost position in the lock case. Axial movement of the lock plunger outwardly relative to the lock case causes the lock bolt to be moved out of its interfering position relative to the sliding door. A latch pawl, controlled by a key received in a key plug mounted in the lock plunger, engages a detent provided in the wall of the lock case. The detent is formed with a sloping surface which acts to cam the latch pawl inwardly as the lock plunger is urged into the lock case to a locking position. Means contained entirely within the lock plunger act, upon rotation of the key in the key plug, to cause the latch pawl to be retracted so that the lock plunger can be withdrawn to the unlocked position. Included in the means contained within the lock plunger is a pivot pin subject to wear and shearing forces in the manner of Patriquin's stud, above.

SUMMARY OF THE INVENTION

In accordance with the present invention, there is provided a plunger lock mechanism in which a shell supported within a casing for movement to and from a locked position carries a plug lock which is rotatable relative to the shell upon insertion of an appropriate key, a bolt means being carried by the plug lock and movable outwardly to a latching position in which it engages latch means provided in the casing. A cam means is so disposed in the casing as to urge the bolt means radially inwardly from its latching position to a retracted position permitting release of the shell from its locked position, the cam means being engaged by the bolt means, upon rotation of the plug lock, at a location external to the shell.

The plug lock is provided with an extension projecting coaxially beyond an inner end of the shell, the bolt means being slidable radially relative to the extension between the latching and retracted positions.

Other objects, features and advantages of the invention will be apparent from the ensuing description in conjunction with the accompanying drawings.

THE DRAWINGS

THE PREFERRED EMBODIMENT

Figure 1:
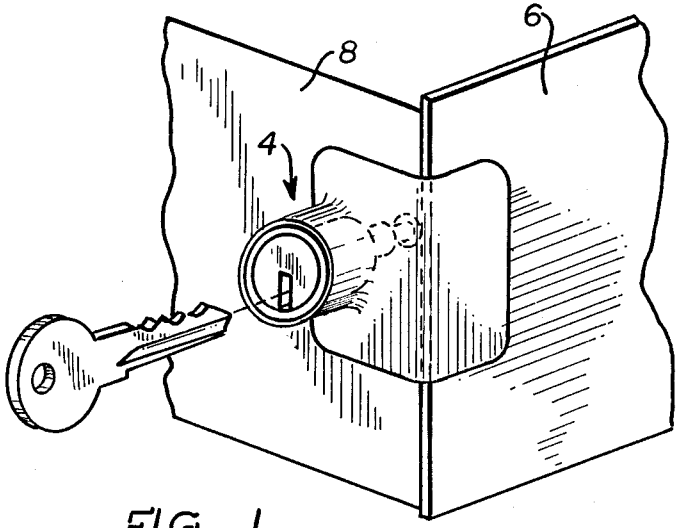
FIG. 1 is an isometric view, in elevation, of a lock mechanism constructed and adapted to operate in accordance with the invention and illustrating a typical mode of installation in a sliding-door cabinet.

Referring first to FIG. 1, a lock mechanism 4 which constitutes a preferred embodiment of the invention is shown in a typical installation whereby it is affixed to a stationary portion of a cabinet 6 in a position to engage a sliding door 8 thereof when it is in a locked or latched position. As will be apparent from the drawings and the ensuing description, the outer direction relative to the lock mechanism is to the left as viewed in FIGS. 1, 2 and 3, and the inner direction to the right.

Figure 2:
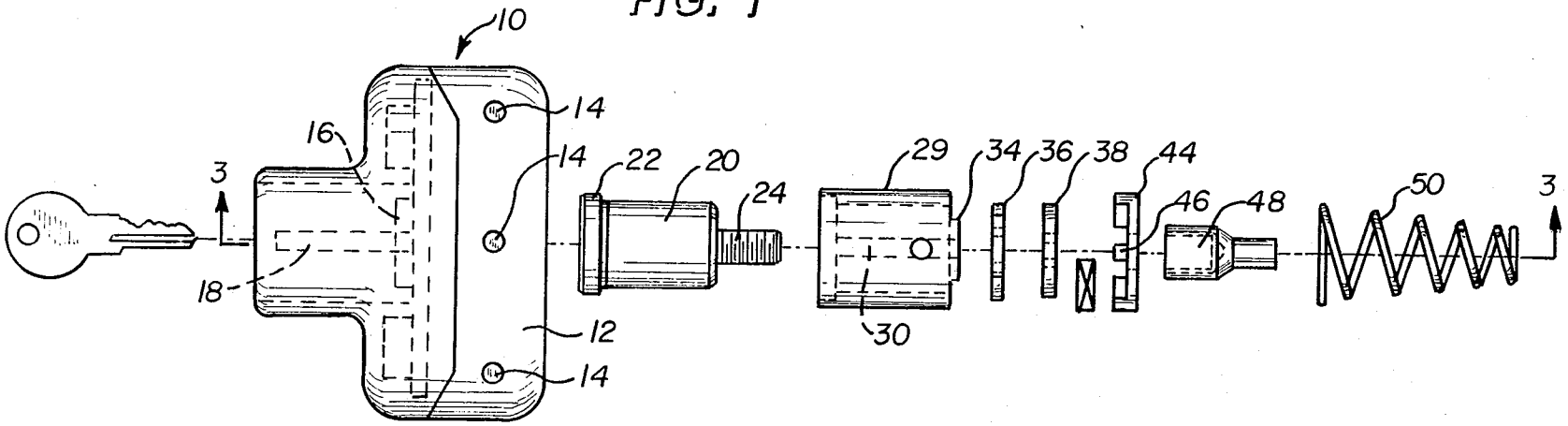
FIG. 2 is an exploded view from one side, in elevation, of the lock mechanism of FIG. 1.
Figure 3:
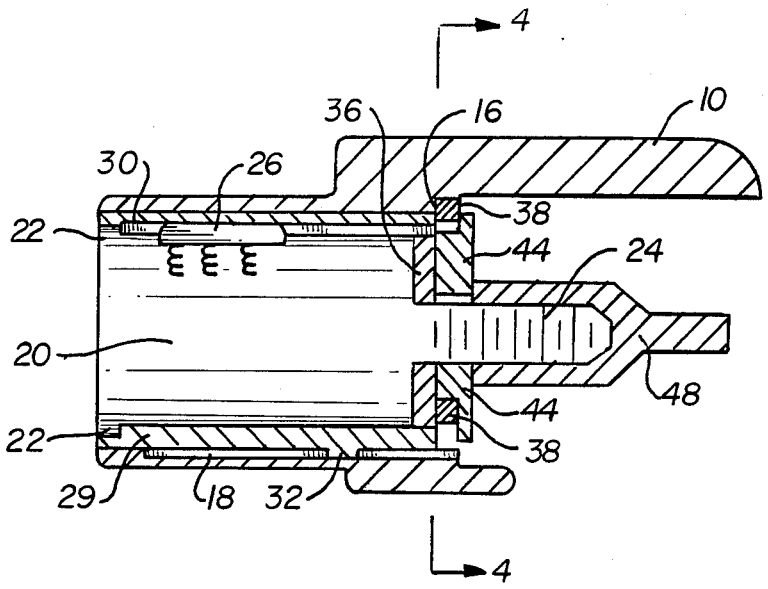
FIG 3 is a sectional view of the lock mechanism taken along line 3—3 of FIG. 2.
Figure 4:
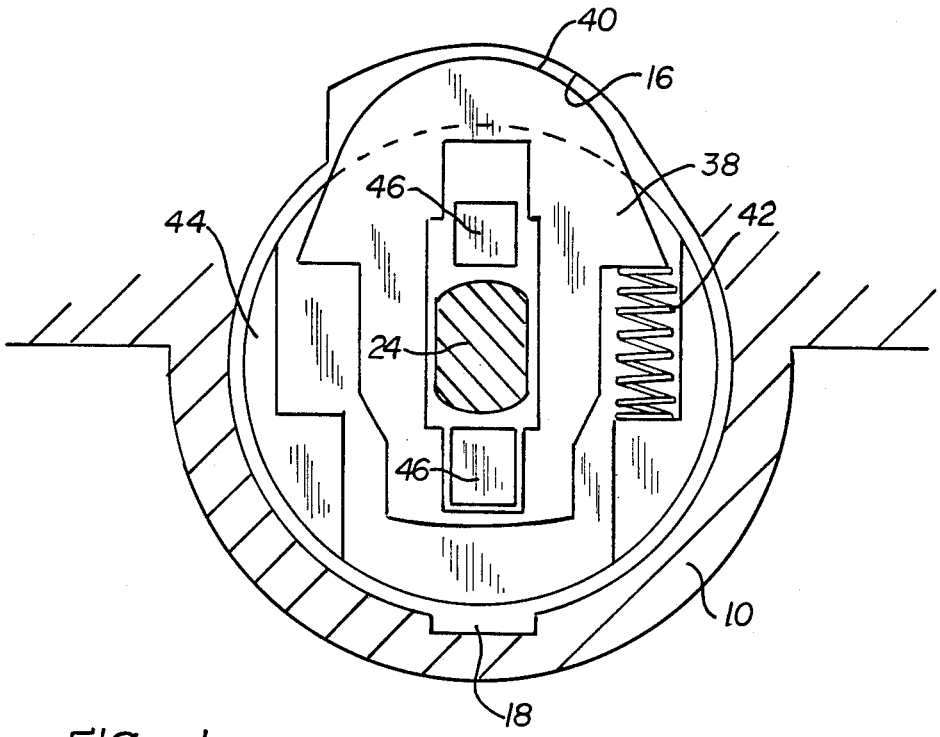
FIG. 4 a cross-sectional view of the lock mechanism taken along line 4—4 of FIG. 3.

The principal components of lock mechanism 4 are best seen in FIGS. 2, 3 and 4. A casing 10, formed by molding a relatively hard plastic material, is provided with an axial bore 11 and a flange 12 extending longitudinally of the casing at an inner open end of the bore. The internal surface of the flange includes several apertures 14 which may be employed in well-known manner to receive fastening means (not shown) for affixing casing 10 to a cabinet in the position illustrated in FIG. 1. The casing is also provided with a cam surface 16 and a latch shoulder **16*a* (FIG. 3) at the inner open end of the axial bore. The latch shoulder extends radially outwardly of the bore and its surface is normal to the axis of the bore, while the cam surface extends axially from the latch shoulder at varying radial distances from the bore axis. A slot 18 formed in the surface of bore 11 is open at the inner end of the bore and extends therefrom to a closed end or stop surface 19 spaced somewhat inwardly of the opposite or outer open end of the bore. The open end of slot 18 is positioned diametrically opposite from cam surface 16**.

As is shown in FIGS. 2 and 3, a conventional metal plug lock 20 of cylindrical form has a shoulder 22 at its outer end and a threaded extension 24 opposite the annular shoulder. The plug lock is provided with an internal tumbler mechanism which controls a movable bar 26 when operated by means of a key 28, all in a manner quite customary in such a lock. A hollow cylindrical shell 29 is also metal and is formed with an internal groove 30 which extends axially along the inner surface of the shell, and a boss 32 which protrudes laterally outwardly of shell 29 at a location diametrically opposite from the groove. Shell 29 is formed with an annular recess 33 in which shoulder 22 is seated when plug lock 20 is received in shell 29 with threaded extension 24 projecting beyond an inner end of the shell. When it is so received, bar 26 will normally be seated within groove 30.

Shell 29 is slidably received in bore 11 for reciprocal movement relative to casing 10 between an outer unlocked position and an inner locked position.

Plug lock 20 is provided with a conventional key slot 28*a* (FIG. 1) at its outer end. When key 28 is fully inserted in the plug lock by way of the key slot, the internal tumbler mechanism is actuated to free bar 26 so that it may be resiliently depressed and thus released from groove 30 when plug lock 20 is rotated relative to shell 29 by means of the key. Perhaps needless to explain, before key 28 is inserted in key slot 28*a*, the internal tumbler mechanism prevents bar 26 from being depressed, whereby it is locked in place in groove 30 to prevent rotation of plug lock 20 relative to shell 29.

Shell 29 is further formed with a rotational stop 34 which extends axially of one end thereof to form a sectional circumferential extension of the shell wall. A stop washer 36 is mounted on plug lock 20 at threaded extension 24 thereof to rotate with the plug lock, the threaded extension being flatted at opposite sides thereof to mate with appropriately formed apertures in the stop washer and other elements as described hereinafter, whereby to render them nonrotational relative to threaded end 24. The stop washer is formed with opposed stepped portions 37 (FIG. 2) which alternately engage rotational stop 34 to limit rotation of plug lock 20 in either direction. These stepped portions are preferably so spaced from one another that plug lock 20 may be rotated through an angle of approximately 90 degrees; that is, a quarter-turn.

A bolt 38 is formed of plastics material with a cam head 40 and an interior guide slot 41, as is shown in FIG. 4. A bolt housing 44 of plastics material is circular in form and is roughly equal to shell 29 in diameter. A pair of axially projecting guides 46, are formed at the outer or bolt side of bolt housing 44, both guides being visible in FIG. 4. The guides extend axially into guide slot 41 of the bolt when the bolt housing is assembled, together with the bolt on threaded extension 24 in nonrotational relation thereto, as previously explained. It will be noted that cam head 40 of the bolt extends beyond the circumferential edge of bolt housing 44. A coil spring 42 is interposed between facing shoulders 42*a* and 42*b* provided respectively on bolt 38 and bolt housing 44, spring 42 acting to bias the bolt in the upward direction as viewed in FIG. 4. If desired, a second coil spring (not shown) may be interposed in similar manner between shoulders 42*c* and 42*d* to augment the force of spring 42. Guide slot 41 and guides 46 are so placed and dimensioned that cam head 40 may be retracted downwardly as viewed in FIG. 4 from a position projecting outwardly of shell 29 to a position within the circumferential edge of bolt housing 44.

As will now be apparent, the bolt, the bolt housing and threaded extension 24 of plug lock 20 are so formed that the bolt and the bolt housing rotate with plug lock 20 relative to shell 29. A pin lock 48 is internally threaded so that it may be received on threaded extension 24 of the plug lock to secure bolt housing 44 to stop washer 36 with bolt 38 interposed there between, at the same time securing plug lock 20 axially relative to shell 29. When the lock mechanism is installed, a spring lock 50 is placed over pin lock 48 to be compressed between bolt housing 44 and cabinet 6 to urge shell 29 in the outer direction or to the left, relative to casing 10, as viewed in FIGS. 1 and 2. In the locked position, pin lock 48 is received in a suitably dimensioned aperture 52 provided in sliding door 8 of cabinet 6, thus securely preventing the door from being opened.

OPERATION

In its latching position, cam head 40 of bolt 38 extends radially outwardly of shell 29 and bolt housing 44 to bear against latch shoulder 16*a* of casing 10 as shown in FIG. 3, thus preventing shell 29 from being moved to the left relative to casing 10 and toward its unlocked position, as viewed in FIGS. 1 and 2, under the urging of spring lock 50. At the same time, bar 26 of the plug lock is firmly secured in groove 30 of shell 29 to prevent plug lock 20 from being rotated relative thereto.

When key 28 is inserted in plug lock 20, bar 26 is freed to be cammed downwardly and out of groove 30 as the plug lock is rotated. Rotation of the plug lock will be clockwise as viewed in FIG. 4. The conventional tumbler mechanism of the plug lock is so arranged that the key is held against removal upon even the slightest rotation of the plug lock. As it is rotated, bolt 38 is rotated with it, whereby cam head 40 of the bolt will engage cam surface 16 and will be constrained to move radially inwardly against the force of coil spring 42 until cam head 40 will no longer bear against latch shoulder 16*a*, which will occur when the key has been rotated through an angle of about 90 degrees. At this point, the bolt will thereby release the shell for movement in the outer direction relative to casing 10, to the left as viewed in FIGS. 1 and 2, under the urging of spring lock 50, whereby pin lock 48 will be withdrawn from aperture 52. During such movement, bolt 38 is held in its retracted position by engagement of cam head 40 with the surface of bore 11. Outward movement of the shell relative to casing 10 is limited by engagement of boss 32 with stop 19 formed by the closed end of slot 18 in the surface of bore 11 which thereby determines the outer or unlocked position of the shell.

As previously described, stop 34 and stop washer 36 cooperate to prevent further rotation of the plug lock at or about 90 degrees from its initial rotational position relative to the shell. Therefore, in its retracted position, bolt 38 will have been rotated 90 degrees clockwise from the position shown in FIG. 4. Assuming that door 8 of the cabinet is in its closed position with aperture 52 aligned with pin lock 48, the door may be locked or latched in the closed position by first employing key 28 to rotate plug lock 20 counterclockwise, as viewed in FIG. 4, through the limit of approximately 90 degrees imposed by rotational stop 34 and stop washer 36, bolt 38 continuing to be held in its radially inner position by engagement of cam head 40 with the surface of bore 11. (When the counterclockwise movement is completed, the key is freed to be removed from the lock if so desired.) The shell with the plug lock may then be manually urged in the inward direction relative to casing 10, or to the right as viewed in FIGS. 1 and 2, against the force of spring lock 50 until bolt 38 emerges from axial bore 11 and is urged by the action of spring 42 into the latching position shown in FIGS. 3 and 4 in which cam head 40 once again engages step 16*a*, thus preventing pin lock 48 from being withdrawn from aperture 52 of the door. This axial movement of shell 29 to its locked position may be carried out with or without key 28 inserted in key slot 28*a*.

While the invention has been described in connection with a specific embodiment thereof, it will be understood that this is by way of illustration and not of limitation and that the scope of the appended claims should be construed as broadly as the prior art will permit.

What is claimed is:

1. A plunger lock mechanism comprising a casing, a shell supported within the casing for reciprocal movement relative thereto between an inner locked position and an outer unlocked position, a plug lock carried within the shell and having an extension projecting coaxially therefrom beyond an inner end of the shell, the plug lock being adapted to receive insertion of a key and being rotatable relative to the shell upon insertion of an appropriate key, bolt means carried by the extension in nonrotational relation thereto, whereby the bolt means is rotatable with the plug lock relative to the shell, the bolt means being slidable radially relative to the extension between a latching position projecting outwardly of the shell and a retracted position inwardly of the latching position, means biasing the bolt means in the direction of the latching position, and latch means disposed in the casing for engagement by the bolt means in the latching position to hold the shell against movement away from the inner locked position and toward the outer unlocked position, the casing being provided with cam means disposed for engagement by the bolt means upon rotation of the plug lock to urge the bolt means to the retracted position and out of engagement with the latch means, whereby to release the shell for movement to the outer unlocked position.

2. In a plunger lock mechanism according to claim 1, the further improvement wherein the plug lock is axially immovable relative to the shell, whereby the plug lock is supported by the shell for reciprocal movement therewith relative to the casing.

3. In a plunger lock mechanism according to claim 1, wherein the casing is provided with a bore having inner and outer open ends, the shell being slidably received within the bore for axial movement between the locked and unlocked positions, the further improvement wherein the latch means comprises a latch shoulder disposed in the casing adjacent to the inner end of the bore and extending radially outwardly therefrom, and the cam means comprises a cam surface in the casing spaced radially outwardly from the bore and extending axially from the shoulder.

4. In a plunger lock mechanism according to claim 1, wherein the latch means is angularly fixed relative to the shell, whereby upon said rotation of the plug lock the bolt means is rotated out of angular alignment with the latch means, the improvement wherein the cam means is so disposed relative to the latch means that the bolt means under the urging of the biasing means is free to assume the latching position in engagement with the latch means in response to rotation of the plug lock, in the direction opposite to the direction of said first-mentioned rotation, to angularly realign the bolt means with the latch means upon movement of the shell to the inner locked position.

* * * * *